US006032469A

United States Patent [19]

Kim et al.

[11] Patent Number: 6,032,469

[45] Date of Patent: Mar. 7, 2000

[54] METHOD OF SUPPLYING COLD AIR IN REFRIGERATORS

[75] Inventors: Seok Ro Kim; Jun Bae Park, both of Changwon, Rep. of Korea

[73] Assignee: LG Electronics Inc., Seoul, Rep. of Korea

[21] Appl. No.: 09/354,907

[22] Filed: Jul. 16, 1999

Related U.S. Application Data

[62] Division of application No. 08/918,137, Aug. 27, 1997.

[30] Foreign Application Priority Data

| | | | |
|---|---|---|---|
| Aug. 27, 1996 | [KR] | Rep. of Korea | 96-35727 |
| Sep. 11, 1996 | [KR] | Rep. of Korea | 96-39243 |
| Oct. 1, 1996 | [KR] | Rep. of Korea | 96-43366 |
| Dec. 19, 1996 | [KR] | Rep. of Korea | 96-67897 |

[51] Int. Cl.[7] ..... F25D 17/08

[52] U.S. Cl. ..... 62/89; 62/187

[58] Field of Search ..... 62/89, 97, 186, 62/187, 408

[56] References Cited

U.S. PATENT DOCUMENTS

| | | | |
|---|---|---|---|
| 5,692,383 | 12/1997 | Jeong et al. | 62/89 |
| 5,775,124 | 7/1998 | Park et al. | 62/408 |
| 5,778,694 | 7/1998 | Jeong | 62/187 |
| 5,799,496 | 9/1998 | Park et al. | 62/89 |

*Primary Examiner*—William E. Tapolcai

*Attorney, Agent, or Firm*—Birch, Stewart, Kolasch & Birch, LLP

[57] ABSTRACT

An apparatus for and a method of supplying cold in a refrigerator, wherein respective temperatures at a plurality of different portions of the interior of the refrigerator are sensed so that cold air is selectively supplied to each refrigerator portion based on the sensed temperature associated with the refrigerator portion, thereby effectively maintaining the refrigerating and freezing compartments of the refrigerator at predetermined temperatures, respectively. The apparatus and method are also configured to concentratedly supply cold air to a portion of the refrigerating compartment of the refrigerator in which a new load is stored. When at least one of the sensed temperatures of the freezing compartment and different portions of the refrigerating compartment is higher than an associated set temperature, concentratedly supplying cold air to the compartment or compartment portion exhibiting the temperature higher than the set temperature. When the sensed temperatures of the freezing compartment and refrigerating compartment portions are higher than the associated set temperatures, respectively, cold air is uniformly supplied to both the compartments.

4 Claims, 10 Drawing Sheets

METHOD OF SUPPLYING COLD AIR IN REFRIGERATORS

This application is a divisional of co-pending application Ser. No. 08/918,137, filed on Aug. 27, 1997, the entire contents of which are hereby incorporated by reference.

BACKGROUND OF THE INVENTION

1. Field of the Invention

The present invention relates to an apparatus for and a method of supplying cold air in a refrigerator, and more particularly to an apparatus for and a method of concentratedly supplying cold air to a temperature-increasing portion of the interior of a refrigerator, based on internal temperatures of the refrigerator at respective portions of the interior of the refrigerator.

2. Description of the Prior Art

FIGS. 1 and 2 illustrate the configuration of a general refrigerator and a general cold air supply configuration applied to the refrigerator configuration, respectively.

As shown in FIGS. 1 and 2, the interior of the refrigerator is divided into a refrigerating compartment 10 and a freezing compartment 30 by a barrier 20. An evaporator 32 is disposed in the rear of the freezing compartment 30. A refrigerant of low temperature and low pressure passes through the evaporator 32. In the rear of the freezing compartment 30, a fan 34 is also disposed near the evaporator to circulate cold air. A refrigerating compartment duct 12 is provided at one side wall of the refrigerating compartment 10 to supply heat-exchanged cold air from the evaporator to the refrigerating compartment 10. A plurality of cold air outlets 12*a*, 12*b* and 12*c* are formed in the refrigerating compartment duct 12. Return ducts 22 and 24 are provided at the barrier 20 to return air of relatively high temperature circulating through the refrigerating and freezing compartments 10 and 30 to the evaporator 32.

Now, the circulation of cold air in the above-mentioned refrigerator will be described. When an internal refrigerating cycle of the refrigerator operates, a refrigerant of low temperature and low pressure passes through the evaporator 32. The refrigerant absorbs heat around the evaporator 32 while passing through the evaporator 32, thereby causing it to be evaporated. As a result, air contacting the evaporator 32 is cooled to a relatively low temperature. The cold air around the evaporator 32 is partially supplied to the freezing compartment 30 and partially supplied to the refrigerating compartment 10 by the fan 34.

The supply of the cold air to the refrigerating compartment 10 is carried out via cold air passages formed in the barrier 20, the refrigerating compartment duct 12, and the cold air outlets 12*a*, 12*b* and 12*c* formed in the refrigerating compartment duct 12.

Meanwhile, a cold air damper 14 is disposed at the upper portion of the refrigerating compartment duct 12 to control the supply of cold air. The cold air damper 14 controls the amount of cold air supplied to the refrigerating compartment duct 12, based on an internal temperature of the refrigerating compartment 10 sensed by a refrigerating compartment temperature sensor 15 installed in the refrigerating compartment 10.

The cold air supplied to the refrigerating compartment 10 via the above-mentioned supply path carries out a heat exchange with foods stored in the refrigerating compartment 10 while circulating in the interior of the refrigerating compartment 10. As a result, the cold air warms to a relatively high temperature. The warm air of relatively high temperature then returns to the evaporator 32 via the refrigerating compartment return duct 24 having an inlet at the lower surface of the barrier 20. The warm air carries out a heat exchange with the evaporator 32, so that it is cooled to a relatively low temperature. As the above-mentioned circulation of cold air is repeatedly carried out, the refrigerating compartment is maintained at a predetermined temperature.

Cold air is also supplied to the freezing compartment 30. After the cold air supplied to the freezing compartment 30 circulates the interior of the freezing compartment 30, it returns to the evaporator 32 via the freezing compartment return duct 22 formed in the barrier 20. This circulation of cold air is repeatedly carried out.

The above-mentioned circulation of cold air is achieved by the operation of the refrigerator, namely, the driving of the refrigerating cycle. The driving of the refrigerating cycle is carried out, based on the current temperature of the refrigerating compartment 10 or freezing compartment 30. That is, when the current of the refrigerating compartment 10 or freezing compartment 30 is higher than a predetermined temperature, the refrigerator operates. However, since the refrigerating compartment 10 and freezing compartment 30 have different temperatures set for the operation of the refrigerator, the operation of the refrigerator is carried out in different manners respectively based on the differently set temperatures.

Where the operation of the refrigerator is determined on the basis of the temperature of the freezing compartment 30, it is determined whether or not the current temperature of the freezing compartment 30 sensed by a freezing compartment temperature sensor 36 installed in the interior of the freezing compartment 30 is higher than a predetermined temperature (for example, −18° C.) set in association with the freezing compartment 30. When the current temperature of the freezing compartment 30 is higher than the predetermined temperature, the operation of the refrigerator is begun. When the current temperature of the freezing compartment 30 is not higher than the predetermined temperature, the operation of the refrigerator is stopped. That is, the operation of the refrigerator is carried out irrespective of the temperature of the refrigerating compartment 10. In this case, the supply of cold air to the refrigerating compartment 10 is controlled by the opening and closing of the refrigerating compartment duct 12 carried out by the cold air damper 14 based on a temperature sensed by the refrigerating compartment temperature sensor 15.

Where the operation of the refrigerator is determined on the basis of the temperature of the refrigerating compartment 10, it is determined whether or not the current temperature of the refrigerating compartment 10 sensed by the refrigerating compartment temperature sensor 15 installed in the interior of the freezing compartment 30 is higher than a predetermined temperature set in association with the refrigerating compartment 10. When the current temperature of the refrigerating compartment 10 is higher than the predetermined temperature, the operation of the refrigerator is begun. When the current temperature of the refrigerating compartment 10 is not higher than the predetermined temperature, the operation of the refrigerator is stopped. That is, the operation of the refrigerator is carried out irrespective of the temperature of the freezing compartment 30.

In the case wherein the operation of the refrigerator is determined on the basis of the temperature of the freezing compartment 30, the supply of cold air may not be carried out even when the current temperature of the refrigerating compartment 10 is higher than the predetermined temperature set in association with the refrigerating compartment 10.

This is because the operation of the refrigerator is determined irrespective of the current temperature of the refrigerating compartment 10. In this case, there is a problem in that it is difficult to maintain the refrigerating compartment 10 in a fresh state.

In the case wherein the operation of the refrigerator is determined on the basis of the temperature of the refrigerating compartment 10, the amount of cold air supplied to the freezing compartment 30 may be insufficient because the predetermined temperature set in association with the refrigerating compartment 10 is relatively high (for example, 3° C.).

As mentioned above, the refrigerating compartment temperature sensor 15 installed in the interior of the refrigerating compartment 10 is used in the case of controlling the supply of cold air based on the current temperature of the refrigerating compartment 10 in order to sense the current temperature of the refrigerating compartment 10. However, it is difficult to sense temperatures of all portions of the refrigerating compartment 10 because the refrigerating compartment temperature sensor 15 is fixed to a selected portion of the refrigerating compartment 10. In other words, the refrigerating compartment temperature sensor 15 can not sense an increase in temperature occurring at a portion of the refrigerating compartment 10 spaced apart from the place where the temperature sensor 15 is disposed. As a result, there is a problem in that a local temperature increase may occur in the refrigerating compartment 10.

In the above-mentioned refrigerator configuration, the total amount of cold air introduced into the refrigerating compartment 10 via the refrigerating compartment duct 12, and the distribution ratio of cold air in different portions of the refrigerating compartment 10, namely, the ratio among the amounts of cold air respectively discharged into different portions of the refrigerating compartment 10 via the cold air outlets 12*a*, 12*b* and 12*c* of the refrigerating compartment duct 12, are fixed upon designing the refrigerator. For this reason, it is impossible to achieve a positive supply of cold air coping with the storage of a new load.

Consequently, it is difficult to achieve an accurate supply of cold air based on a temperature deviation in the refrigerating compartment in the above-mentioned case wherein the supply of cold air is controlled on the basis of the temperature of the refrigerating compartment. Furthermore, the amount of cold air supplied to each portion of the refrigerating compartment is fixed by the associated cold air outlet formed in the refrigerating compartment duct. In other words, each portion of the refrigerating compartment is supplied with a set, constant amount of cold air, irrespective of whether or not a new load is stored in the refrigerating compartment portion.

SUMMARY OF THE INVENTION

Therefore, an object of the invention is to provide a cold air supplying apparatus for a refrigerator which senses respective temperatures at a plurality of different portions of the interior of the refrigerator and selectively supplies cold air to each refrigerator portion based on the sensed temperature associated with the refrigerator portion, thereby being capable of effectively maintaining the refrigerating and freezing compartments of the refrigerator at predetermined temperatures, respectively.

Another object of the invention is to provide a cold air supplying apparatus for a refrigerator capable of concentratedly supplying cold air to a portion of the refrigerating compartment of the refrigerator in which a new load is stored.

Another object of the invention is to provide a cold air supplying method in a refrigerator capable of efficiently supplying cold air to the refrigerating and freezing compartments of the refrigerator respectively based on the temperatures of the refrigerating and freezing compartments while concentratedly supplying cold air to a temperature-increasing portion of the refrigerating compartment.

In accordance with one aspect, the present invention provides an apparatus for supplying cold air in a refrigerator comprising: cold air supplying means for supplying cold air produced by a heat exchange to a freezing compartment and a refrigerating compartment respectively defined in the interior of the refrigerator; distributing means for distributing the cold air supplied to different portions of the refrigerating compartment; and control means for controlling a supply of cold air to the distributing means.

In accordance with another aspect, the present invention provides a method for supplying cold air in a refrigerator including temperature sensing means adapted to sense respective temperatures of different portions of a refrigerating compartment defined in the refrigerator and a temperature of a freezing compartment defined in the refrigerator, and cold air supplying means adapted to supply cold air to the portions of the refrigerating compartment and the freezing compartment, comprising the steps of: sensing respective temperatures of the portions of the refrigerating compartment and a temperature of the freezing compartment; when at least one of the sensed temperatures is higher than an associated set temperature, concentratedly supplying cold air to the compartment or compartment portion exhibiting the temperature higher than the set temperature; and when the sensed temperatures of the freezing compartment and refrigerating compartment portions are higher than the associated set temperatures, respectively, uniformly supplying cold air to both the compartments.

In accordance with another aspect, the present invention provides a method for supplying cold air in a refrigerator including temperature sensing means adapted to sense respective temperatures of different portions of a refrigerating compartment defined in the refrigerator and a temperature of a freezing compartment defined in the refrigerator, and cold air supplying means adapted to supply cold air to the portions of the refrigerating compartment and the freezing compartment, comprising the steps of: sensing respective temperatures of the portions of the refrigerating compartment and a temperature of the freezing compartment; when all the sensed temperatures of refrigerating compartment portions are higher than an associated set temperature, uniformly supplying cold air to all the refrigerating compartment portions; when at least one of the sensed temperatures of the refrigerating compartment portions is higher than the associated set temperature, concentratedly supplying cold air to the refrigerating compartment portion exhibiting the temperature higher than the set temperature; and when the sensed temperature of the freezing compartment is higher than an associated set temperature, cutting off the supply of cold air to the refrigerating compartment.

In accordance with another aspect, the present invention provides a method for supplying cold air in a refrigerator including a plurality of temperature sensing means adapted to sense respective temperatures of different portions of a refrigerating compartment defined in the refrigerator, and cold air supplying means adapted to supply cold air to the portions of the refrigerating compartment, comprising the steps of: sensing respective temperatures of the portions of the refrigerating compartment; when at least one of the sensed temperatures is higher than an associated set temperature, concentratedly supplying cold air to the compartment portion exhibiting the temperature higher than the set temperature; and when an average temperature of the sensed temperatures is higher than the associated set temperature, uniformly supplying cold air to all the portions of the refrigerating compartment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Referring to FIGS. 3 to 6, a cold air supplying apparatus for a refrigerator configured in accordance with a first embodiment of the present invention is illustrated.

Figure 1:
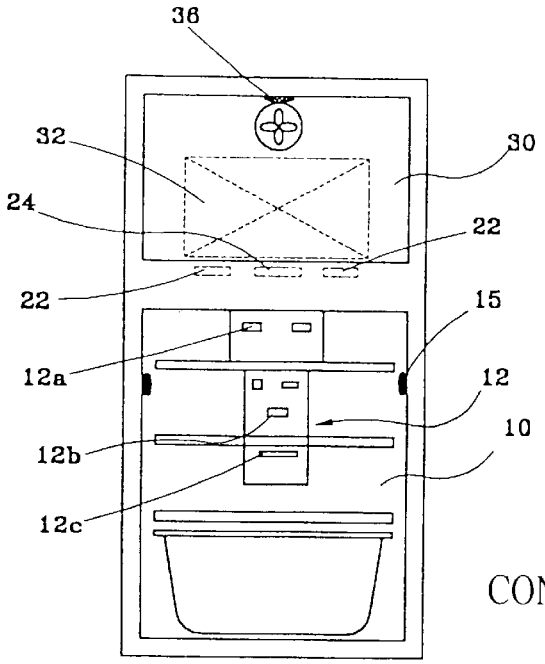
FIG. 1 CONVENTIONAL ART
FIG. 1 is a front view illustrating the configuration of a general refrigerator in a door-open state.
Figure 2:
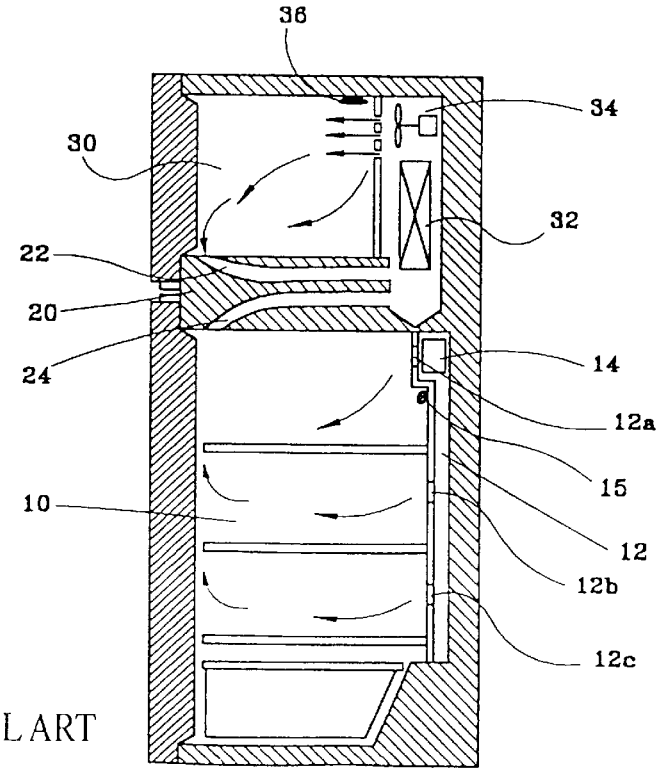
FIG. 2 CONVENTIONAL ART
FIG. 2 is a sectional view illustrating the configuration of the general refrigerator.
Figure 3:
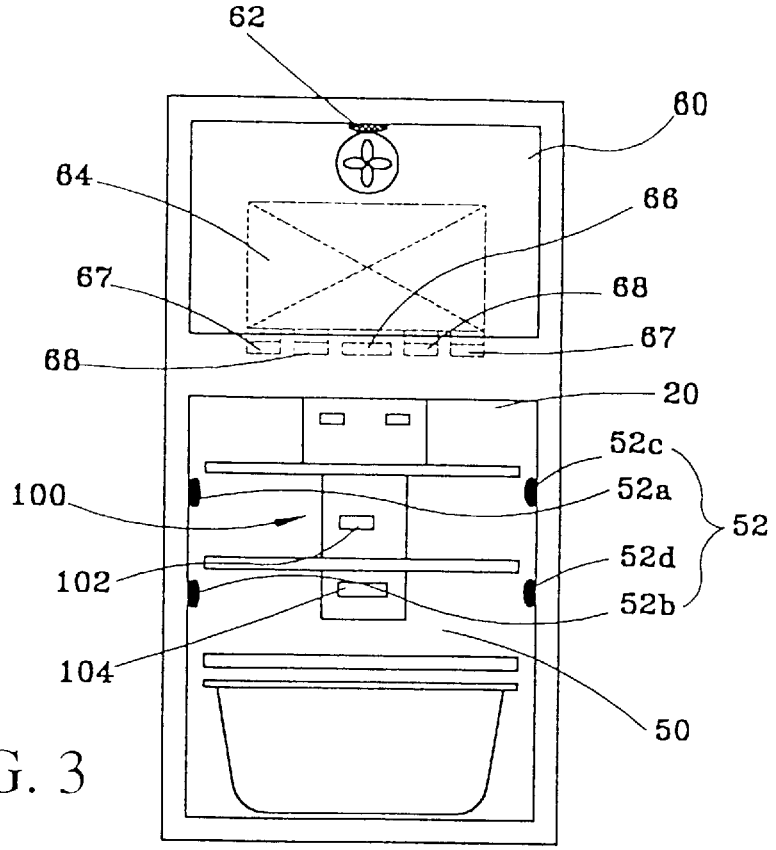
FIG. 3 is a front view illustrating the configuration of a cold air supplying apparatus according to a first embodiment of the present invention applied to a refrigerator, in a door-open state of the refrigerator.

As shown in FIG. 3, a freezing compartment temperature sensor 62 is disposed at the upper portion of a freezing compartment 60 defined in the interior of the refrigerator in order to sense the temperature of the freezing compartment 60. A plurality of refrigerating compartment temperature sensors 52 are disposed at different portions of a refrigerating compartment 50 defined in the interior of the refrigerator in order to sense temperatures of the refrigerating compartment portions, respectively. The refrigerating temperature sensors 52 are appropriately arranged at the upper, lower, right and left portions of the refrigerating compartment 50, respectively, so that they sense temperatures of various refrigerating compartment portions. In the illustrated case, the refrigerating temperature sensors 52 include a pair of middle temperature sensors 52*a* and 52*c* respectively arranged at opposite lateral ends of the middle portion of the refrigerating compartment 50 and a pair of lower temperature sensors 52*b* and 52*d* respectively arranged at opposite lateral ends of the lower portion of the refrigerating compartment 50.

The supply of cold air to the refrigerating compartment 50 is carried out via a refrigerating compartment duct 100 which is disposed in the rear of the refrigerating compartment 50. The refrigerating compartment duct 100 receives cold air from an evaporator 64 via a cold air passage 66. The evaporator 64 performs a heat exchange with ambient air, thereby producing cold air. A pair of return ducts 67 and 68 are arranged on the opposite sides of the cold air passage 66, respectively. The return duct 67 is a freezing compartment return duct for returning cold air circulating in the freezing compartment 60 to the evaporator 64 whereas the return duct 68 is a refrigerating compartment return duct for returning cold air circulating in the refrigerating compartment 50 to the evaporator 64.

The refrigerating compartment duct 100 is provided with a plurality of cold air outlets (in the illustrated case, two cold air outlets 102 and 104) to discharge cold air into the refrigerating compartment 50. The cold air outlet 102 is open to the middle portion of the refrigerating compartment 50 at the same level as the middle temperature sensors 52*a* and 52*c*. The cold air outlet 104 is open to the lower portion of the refrigerating compartment 50 at the same level as the lower temperature sensors 52*b* and 52*d*. Accordingly, the middle cold air outlet 102 supplies cold air or cuts off the supply of cold air based on temperatures respectively sensed by the middle temperature sensors 52*a* and 52*c* whereas the lower cold air outlet 104 supplies cold air or cuts off the supply of cold air based on temperatures respectively sensed by the lower temperature sensors 52*b* and 52*d*. This will be described hereinafter.

Figure 4:
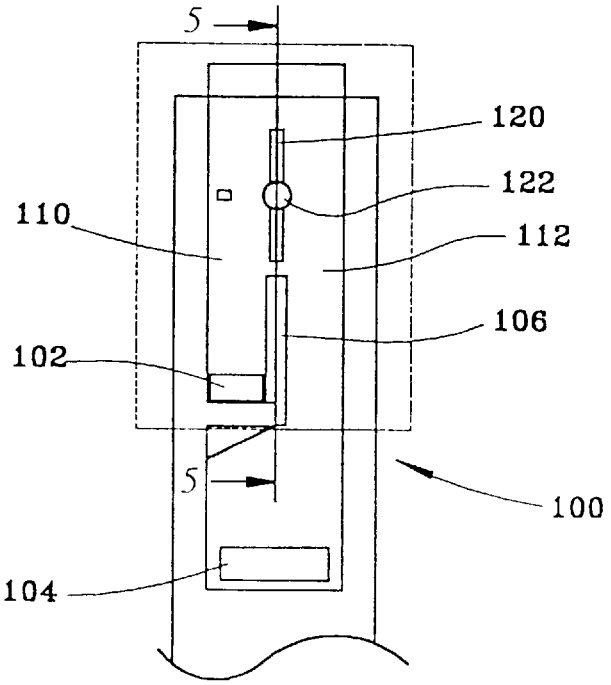
FIG. 4 is a schematic view illustrating the inner construction of a refrigerating compartment duct according to the first embodiment of the present invention.

As shown in FIG. 4, the refrigerating compartment duct 100 is divided into two cold air ducts 110 and 112 respectively adapted to guide cold air to the middle and lower cold air outlets 102 and 104. The division of the refrigerating compartment duct 100 into the ducts 110 and 112 is obtained by a vertical partition plate 106 vertically arranged in the interior of the refrigerating compartment duct 100. The middle cold air duct 110, which is arranged at the left portion of the refrigerating compartment duct 100 when viewed in FIG. 4, communicates with the middle cold air outlet 102 at its lower end. Accordingly, cold air introduced in the middle cold air duct 110 is discharged into the refrigerating compartment 50 through the middle cold air outlet 102. The lower cold air duct 112, which is arranged at the right portion of the refrigerating compartment duct 100 when viewed in FIG. 4, communicates with the lower cold air outlet 104 at its lower end. Accordingly, cold air introduced in the lower cold air duct 112 is discharged into the refrigerating compartment 50 through the lower cold air outlet 104.

Figure 5:
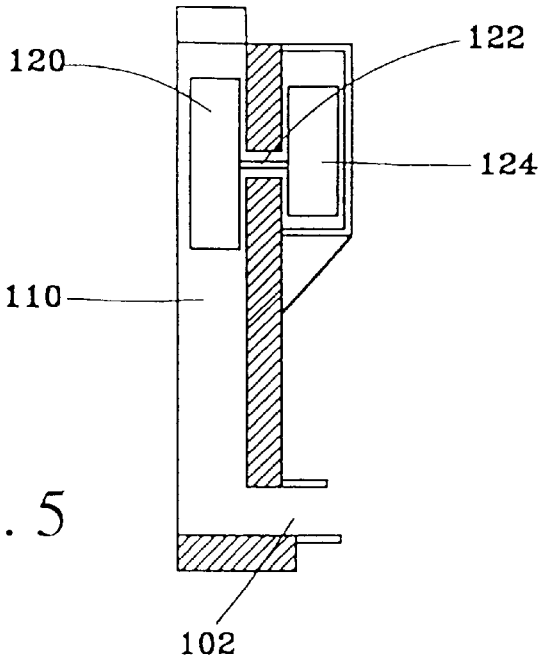
FIG. 5 is a cross-sectional view taken along the line 5—5 of FIG. 4.

The cold air supplying apparatus includes a cold air distribution device for controlling the supply of cold air to the middle and lower cold air ducts 110 and 112. As shown in FIGS. 4 and 5, the cold air distribution device includes a baffle plate 120 fixedly mounted on a rotating shaft 122 arranged on the same axis as the vertical partition plate 106 in such a manner that it is rotated by a rotation of the rotating shaft 122. The cold air distribution device also includes a drive motor 124 coupled to the rotating shaft 122 to rotate the rotating shaft 122, thereby controlling a rotation angle of the baffle plate 120. In a state shown in FIG. 4, the amounts of cold air distributed from the refrigerating compartment duct 100 to the middle and lower cold air ducts 110 and 112 are equal to each other because the baffle plate 120 is positioned in a vertical state between the middle and lower cold air ducts 110 and 112.

The amounts of cold air respectively supplied to the refrigerating compartment 50 through the cold air outlets 102 and 104 of the refrigerating compartment duct 100 can be adjusted by adjusting the rotation angle of the baffle plate 120. This adjustment will be described in conjunction with FIG. 6. At a first position P1, namely, a vertical position, of the baffle plate 120, substantially the same amount of cold air are distributed to the middle and lower cold air ducts 110 and 112, respectively. At a second position P2 where the baffle plate 120 is in a state in which it rotates about 45° in a clockwise direction, most of the cold air introduced in the refrigerating compartment duct 100 is supplied to the middle cold air duct 110, as shown by the solid arrow in FIG. 6. Accordingly, it is possible to concentratedly supply cold air to the middle portion of the refrigerating compartment 50 via the middle cold air outlet 102 at the second position P2 of the baffle plate 120. Such a concentrated cooling is particularly advantageous in the case wherein the middle portion of the refrigerating compartment 50 increases in temperature due to a new load stored therein.

When the baffle plate 120 is positioned at a third position P3 as it rotates 90° from the first position P1 in a clockwise direction, the refrigerating compartment duct 100 is substantially closed. In this state, there is little or no cold air discharged into the refrigerating compartment 50 through the cold air outlets 102 and 104. Where the refrigerator operates under the condition in which the baffle plate 120 is positioned at the third position P3, cold air produced from the evaporator 64 is concentratedly supplied to the freezing compartment 60. In this case, accordingly, it is possible to concentratedly cool the freezing compartment 60. This concentrated cooling is particularly advantageous in the case wherein the freezing compartment 60 increases in temperature due to a new load stored therein.

Figure 6:
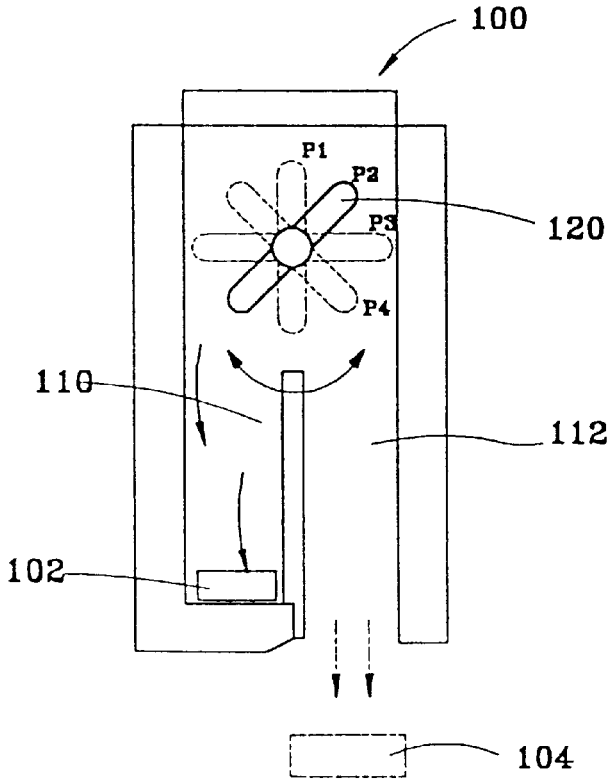
FIG. 6 is a schematic view illustrating a cold air distribution function of the refrigerating compartment duct according to the first embodiment of the present invention.

When the baffle plate 120 rotates to a fourth position P4, most of the cold air introduced in the refrigerating compartment duct 100 is supplied to the lower cold air duct 112, as shown by the broken arrow in FIG. 6. Accordingly, it is possible to concentratedly supply cold air to the lower portion of the refrigerating compartment 50 via the lower cold air outlet 104 at the fourth position P4 of the baffle plate 120. This concentrated cooling is particularly advantageous in the case wherein the lower portion of the refrigerating compartment 50 increases in temperature due to a new load stored therein.

The rotation of the baffle plate 102 is achieved by an operation of the drive motor 124. The drive motor 124 is controlled by a control unit (not shown) based on temperatures respectively sensed by the freezing and refrigerating compartment temperature sensors 62 and 52.

Now, a cold air supplying method carried out using the cold air supplying apparatus according to the above-mentioned embodiment of the present invention will be described in conjunction with FIGS. 6 and 7.

Figure 7:
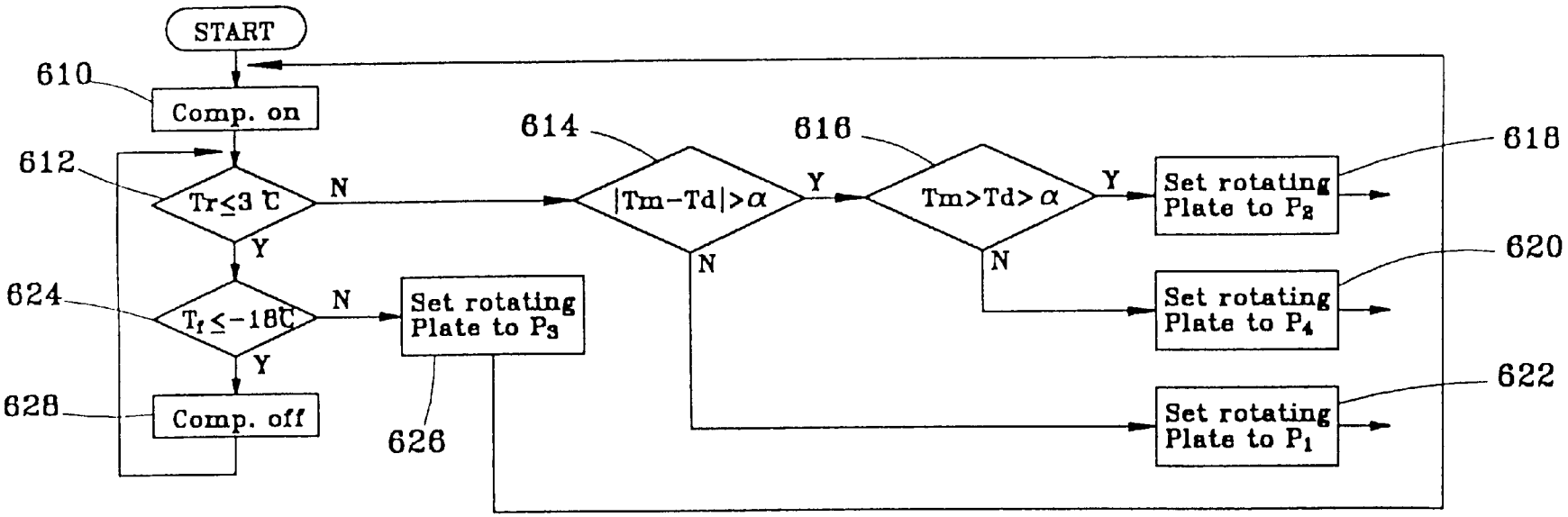
FIG. 7 is a flow chart illustrating a cold air supplying method carried out using the cold air supplying apparatus according to the first embodiment of the present invention.

FIG. 7 is a flow chart illustrating a cold air supplying procedure carried out in accordance with the cold air supplying method in the case wherein desired temperatures of the refrigerating and freezing compartments 50 and 60 are set to 3° C. and −18° C., respectively.

In accordance with this cold air supplying method, when the refrigerator operates, a compressor equipped in the refrigerator turns on, thereby driving a refrigerating cycle. Accordingly, the supply of cold air is initiated (Step 610). It is then determined at step 612 whether or not the average temperature Tr of the refrigerating compartment 50 is lower than a set temperature (3° C.). When it is determined that the average temperature Tr of the refrigerating compartment 50 is not lower than the set temperature, it is determined at step 614 whether or not a difference between the average of temperatures sensed by the middle temperature sensors 52*a* and 52*c*, namely, the average temperature Tm, and the average of temperature sensed by the lower temperature sensors 52*b* and 52*d*, namely, the average temperature Td, is higher than a predetermined temperature deviation $\alpha$ (for example, 1° C.). When it is determined that the difference between the average temperatures Tm and Td is higher than the predetermined temperature deviation $\alpha$, it is determined at step 616 whether or not the average temperature Tm associated with the middle temperature sensors 52*a* and 52*c* is higher than the average temperature Td associated with the lower temperature sensors 52*b* and 52*d*. Where it is determined at step 616 that the average temperature Tm is higher than the average temperature Td, it is regarded that the temperature at the middle portion of the refrigerating compartment 50 is higher than the temperature at the lower portion of the refrigerating compartment 50. In this case, accordingly, the baffle plate 120 rotates at step 618 so that it is set to the second position P2 of FIG. 6. At the second position P2 of the baffle plate 120, cold air introduced in the refrigerating compartment duct 100 is mainly discharged in a concentrated manner into the middle portion of the refrigerating compartment 50 through the middle cold air outlet 102. This case corresponds to the case wherein the middle portion of the refrigerating compartment 50 (namely, the refrigerating compartment portion provided with the middle temperature sensors 52*a* and 52*c*) has increased in temperature due to a new load stored therein. In this case, accordingly, it is possible to more efficiently maintain the refrigerating compartment 50 at the set temperature by concentratedly supplying cold air to the middle portion of the refrigerating compartment 50.

Where it is determined at step 616 that the average temperature Tm associated with the middle temperature sensors 52*a* and 52*c* is not higher than the average temperature Td associated with the lower temperature sensors 52*b* and 52*d*, the baffle plate 120 rotates at step 620 so that its position is set to the fourth position P4 of FIG. 6. At the fourth position P4 of the baffle plate 120, cold air introduced in the refrigerating compartment duct 100 is mainly discharged in a concentrated manner into the lower portion of the refrigerating compartment 50 through the lower cold air outlet 104. This case corresponds to the case wherein the lower portion of the refrigerating compartment 50 (namely, the refrigerating compartment portion provided with the lower temperature sensors 52*a* and 52*c*) has increased in temperature due to a new load stored therein.

Where it is determined at step 614 that the difference between the average temperature Tm associated with the middle temperature sensors 52*a* and 52*c* and the average temperature Td associated with the lower temperature sensors 52*b* and 52*d* is not higher than the predetermined temperature deviation $\alpha$, it is regarded that cold air should be supplied to all portions of the refrigerating compartment 50. In this case, accordingly, the baffle plate 120 rotates at step 622 so that it is set to the first position P1 of FIG. 6. At the first position P1 of the baffle plate 120, cold air is uniformly supplied to all portions of the refrigerating compartment 50.

When it is determined at step 612 that the average temperature Tr of the refrigerating compartment 50 is lower than the set temperature (3° C.), it is determined at step 624 whether or not the current temperature Tf of the freezing compartment 60 is lower than a set temperature (−18° C.). When it is determined that the current temperature Tf of the freezing compartment 60 is lower than the set temperature, the compressor turns off at step 628, thereby causing the refrigerator to be shut down. Where it is determined at step 624 that the current temperature Tf of the freezing compartment 60 is not lower than the set temperature, the baffle plate 120 rotates at step 626 so that it is set to the third position P3 of FIG. 6. In this state, the refrigerating compartment duct 100 is substantially closed. In this case, accordingly, the freezing compartment 60 is rapidly cooled to its set temperature.

As is apparent from the above description, the above-mentioned embodiment of the present invention is configured to concentratedly supply cold air to the freezing compartment 60 or a portion of the refrigerating compartment 50 increasing in temperature. As cold air is locally supplied in a concentrated manner to a portion of the interior of the refrigerator increasing in temperature, it is possible to rapidly cool the entire portion of the refrigerator to a desired temperature. In particular, it is possible to effectively control the freezing compartment or each portion of the refrigerating compartment when a new load is stored in the refrigerator.

In the above-mentioned embodiment of the present invention, it has been described that the temperature control for the refrigerator is achieved by preferentially performing the temperature control for the refrigerating compartment 50. That is, the step (Step 112) of comparing the temperature Tr of the refrigerating compartment 50 with a set temperature is executed prior to the step (Step 624) of comparing the temperature Tf of the freezing compartment 60 with a set temperature. However, it is possible to preferentially perform the temperature control for the freezing compartment 60 by executing step 624 prior to step 612. In this case, the principle of concentratedly supplying cold air to a portion of the interior of the refrigerator locally increasing in temperature is still achieved even though the temperature control for the freezing compartment 60 is preferentially carried out.

In the above-mentioned embodiment, the local temperature sensing for the refrigerating compartment 50 is achieved by sensing the temperature of the middle portion of the refrigerating compartment 50 using a pair of middle temperature sensors 52*a* and 52*c* while sensing the temperature of the lower portion of the refrigerating compartment 50 using a pair of lower temperature sensors 52*b* and 52*d*. However, only one temperature sensor may be used to sense the temperature of each portion of the refrigerating compartment 50. Alternatively, a plurality of temperature sensors may also be used to sense the temperature of each portion of the refrigerating compartment 50. In the latter case, the average value of temperatures sensed by the temperature sensors is derived. In any case, it is possible to achieve a local temperature sensing.

The installation positions of the middle temperature sensors 52*a* and 52*c* and lower temperature sensors 52*b* and 52*d* have been described only for illustrative purposes in order to explain the principle of the present invention, namely, the principle of sensing different portions of the refrigerating compartment and concentratedly supplying cold air to a temperature-increasing portion of the refrigerating compartment. Accordingly, it is also possible to implement the present invention using upper and lower temperature sensors respectively adapted to sense temperatures of the upper and lower portions of the refrigerating compartment. In this case, it is necessary to form cold air outlets at portions of the refrigerating compartment duct respectively corresponding to the upper and lower portions of the refrigerating compartment where the upper and lower temperature sensors are installed.

Figure 8:
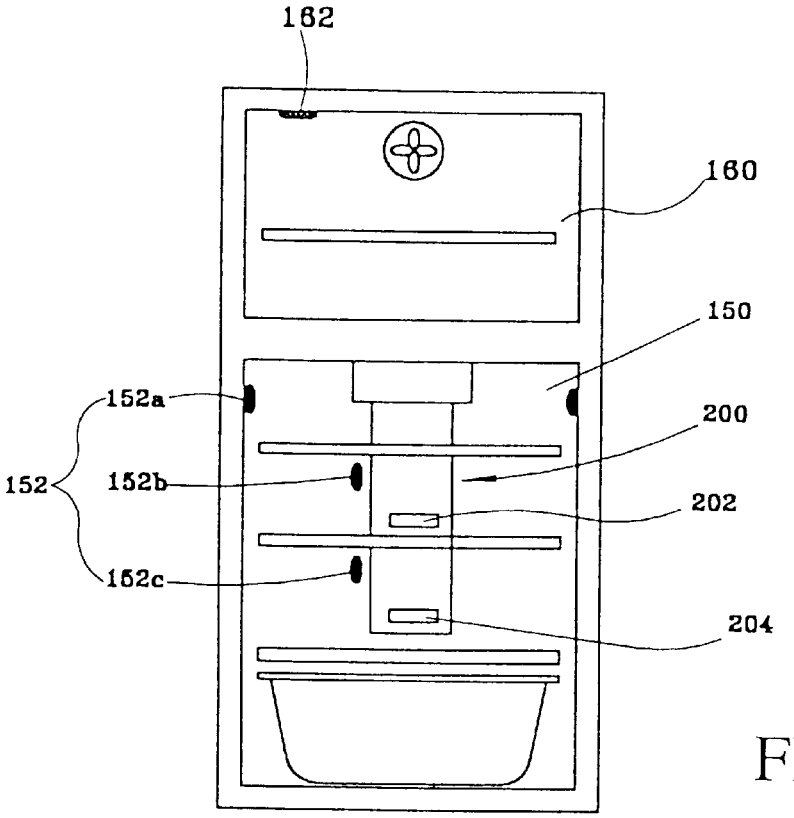
FIG. 8 is a schematic view illustrating the inner construction of a refrigerating compartment duct according to a second embodiment of the present invention.
Figure 9:
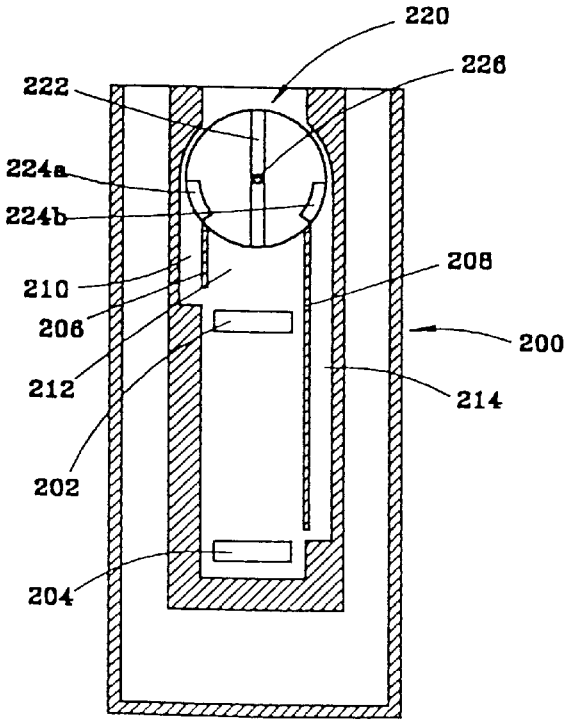
FIG. 9 is a sectional view illustrating the inner construction of the refrigerating compartment duct according to the second embodiment of the present invention.

Referring to FIGS. 8 to 10, a cold air supplying apparatus for a refrigerator configured in accordance with a second embodiment of the present invention is illustrated. The configuration of this embodiment is similar to that of the first embodiment, except for the configuration of the refrigerating compartment duct for the locally concentrated cooling.

As shown in FIG. 8, a freezing compartment temperature sensor 162 is disposed in the interior of a freezing compartment 160 defined in the interior of the refrigerator in order to sense the temperature of the freezing compartment 160. A plurality of refrigerating compartment temperature sensors 152 are disposed at different portions of a refrigerating compartment 150 defined in the interior of the refrigerator in order to sense temperatures of the refrigerating compartment portions, respectively. In the illustrated case, the refrigerating temperature sensors 152 include a pair of upper temperature sensors 152*a* respectively arranged at opposite lateral ends of the upper portion of the refrigerating compartment 150, a middle temperature sensor 152*b* arranged at the middle portion of the refrigerating compartment 150, and a lower temperature sensor 152*c* arranged at the lower portion of the refrigerating compartment 150. These temperature sensors 152 are adapted to sense portions of the refrigerating compartment 150 where they are installed, so as to achieve a concentrated supply of cold air, as in the first embodiment.

The supply of cold air to the refrigerating compartment 150 is carried out via a refrigerating compartment duct 200. The refrigerating compartment duct 200 is provided with a middle cold air outlet 202 communicating with the middle portion of the refrigerating compartment 150 and a lower cold air outlet 204 communicating with the lower portion of the refrigerating compartment 150. The cold air introduced in the refrigerating compartment duct 200 is supplied to the refrigerating compartment 150 via the cold air outlets 202 and 204.

As shown in FIG. 9 which shows the inner construction of the refrigerating compartment duct 200, the refrigerating compartment duct 200 is divided into a middle guide duct 210 for guiding cold air in a concentrated manner to the middle cold air outlet 202, a lower guide duct 214 for guiding cold air in a concentrated manner to the lower cold air outlet 204, and a common guide duct 212 for guiding cold air in common to both the cold air outlets 202 and 204.

The middle guide duct 210 is defined by a portion of one side wall of the refrigerating compartment duct 200 extending downwardly to the middle cold air outlet 202 and having a step at the lower end thereof, and a vertical partition plate 206 extending downwardly to the same level as the step while being laterally spaced from the side wall of the refrigerating compartment duct 200. Accordingly, cold air introduced in the middle guide duct 210 can be concentratedly discharged into the refrigerating compartment 150 through the middle cold air outlet 202.

The lower guide duct 214 is defined by a portion of the other side wall of the refrigerating compartment duct 200 extending downwardly to the lower cold air outlet 204 and having a step at the lower end thereof, and a vertical partition plate 208 extending downwardly to the same level as the step while being laterally spaced from the side wall of the refrigerating compartment duct 200. Accordingly, cold air introduced in the lower guide duct 214 can be concentratedly discharged into the refrigerating compartment 150 through the lower cold air outlet 204.

The common guide duct 212 is defined between the vertical partition plates 206 and 208 in such a manner that it occupies the vertically-extending central portion of the refrigerating compartment duct 200. Accordingly, cold air introduced in the common guide duct 212 is discharged in a common manner to the refrigerating compartment 150 through both the middle and lower cold air outlets 202 and 204.

On the upper end of the refrigerating compartment duct 200 which consists of the above-mentioned middle, lower and common guide ducts 210, 214 and 212, a cold air distribution assembly 220 is installed to distribute cold air to those guide ducts. As shown in FIG. 9, the cold air distribution assembly includes a cylindrical baffle plate 222 fixedly mounted on a rotating shaft 226 in such a manner that it is rotated by rotation of the rotating shaft 226. The cylindrical baffle plate 222 has a radially-extending central plate portion and an open peripheral portion. The cold air distribution assembly also includes a pair of blocking ribs 224 for blocking desired portions of the open periphery of the cylindrical baffle plate 222, respectively. The blocking ribs 224 include blocking ribs 224*a* and 224*b* respectively adapted to block the middle and lower guide ducts 210 and 214 simultaneously in a state shown in FIG. 9, namely, a state in which the central plate portion of the cylindrical baffle plate 222 is vertically positioned. The rotating shaft 226, to which the cold air distribution assembly is fixedly mounted, is coupled to a drive motor (not shown) so that it is rotated by a drive force of the drive motor. In other words, the rotation of the cold air distribution assembly 220 is controlled by the drive motor. Of course, the control of the drive motor is carried out, based on temperatures respectively sensed by the freezing and refrigerating compartment temperature sensors 152 and 162.

Now, the distribution of cold air introduced in the refrigerating compartment duct 200 carried out by the rotation of the cold air distribution assembly 220 will be described in conjunction with FIGS. 10A to 10D.

Figure 10A:
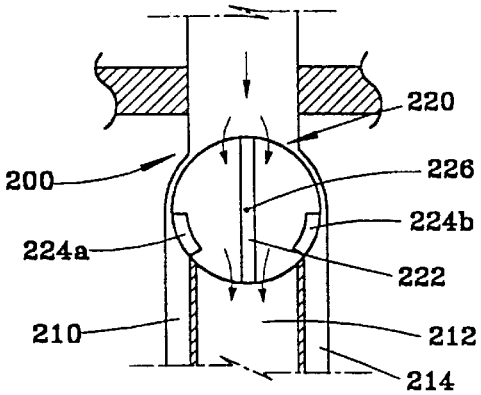
FIGS. 10A to 10D are schematic views respectively illustrating a cold air distribution function of the refrigerating compartment duct according to the second embodiment of the present invention.

The state of FIG. 10A corresponds to a state in which the central plate portion of the baffle plate 222 is vertically positioned. In this state, the middle and lower guide ducts 210 and 214 are blocked by the ribs 224*a* and 224*b*, respectively. Accordingly, cold air introduced in the refrigerating compartment duct 200 is supplied to the refrigerating compartment 150 only through the common guide duct 212. Therefore, this state corresponds to a state in which cold air is discharged in a common manner through the middle and lower cold air outlets 202 and 204 of the refrigerating compartment duct 200. Such a common discharge of cold air through the cold air outlets 202 and 204 is carried out when the temperature of the refrigerating compartment 150 is higher than a set temperature associated with the refrigerating compartment 150 at all portions of the refrigerating compartment 150 while there is no temperature deviation in the refrigerating compartment 150.

Figure 10B:
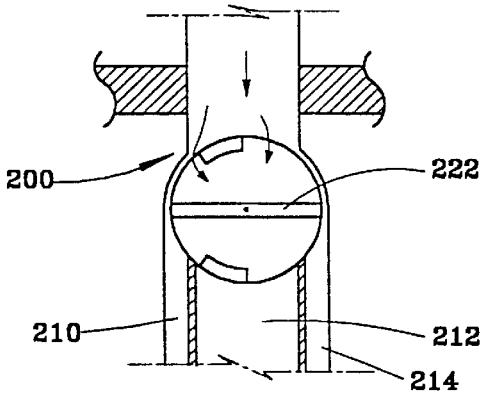

The state of FIG. 10B corresponds to a state in which the central plate portion of the baffle plate 222 is horizontally positioned. In this state, there is little or no cold air introduced in the refrigerating compartment duct 200. This state corresponds to a state in which the temperature of the freezing compartment 160 is higher than a set temperature associated with the freezing compartment 160, even though the refrigerating compartment 150 is maintained at a low temperature corresponding to its set temperature. That is, this state requires a concentrated supply of cold air to the freezing compartment 160.

Figure 10C:
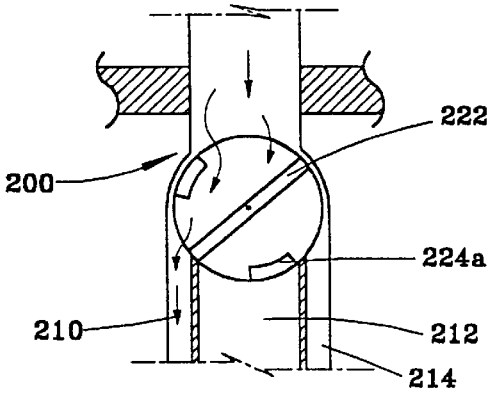

The state of FIG. 10C corresponds to a state in which the central plate portion of the baffle plate 222 inclines to the left so that cold air is introduced only into the middle guide duct 210 defined at the left portion of the refrigerating compartment duct 200. In this state, accordingly, cold air is concentratedly discharged into the refrigerating compartment 150 through the middle cold air outlet 202. This concentrated supply of cold air is particularly advantageous in the case wherein the middle portion of the refrigerating compartment 150 increases in temperature due to a new load stored therein.

Figure 10D:
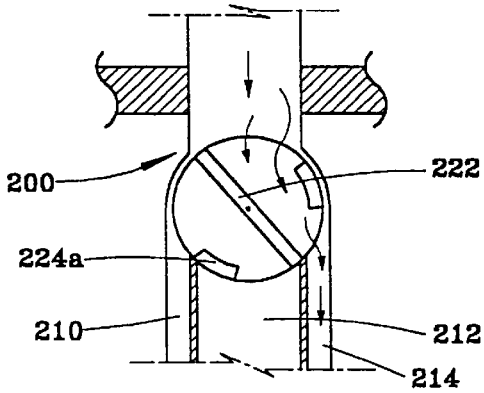

On the other hand, the state of FIG. 10D corresponds to a state in which the central plate portion of the baffle plate 222 inclines to the right so that cold air is introduced only into the lower guide duct 214 defined at the right portion of the refrigerating compartment duct 200. In this state, accordingly, cold air is concentratedly discharged into the refrigerating compartment 150 through the lower cold air outlet 204. This concentrated supply of cold air is particularly advantageous in the case wherein the lower portion of the refrigerating compartment 150 increases in temperature due to a new load stored therein.

From the above description, it is understood that in this embodiment, the cold air distribution assembly rotates to adjust the position of the baffle plate 222, thereby achieving a concentrated supply of cold air to a desired portion of the interior of the refrigerator.

A cold air supplying method carried out using the cold air supplying apparatus according to the above-mentioned second embodiment of the present invention will now be described briefly.

In accordance with this cold air supplying method, when the refrigerator turns on, the temperature of the refrigerating compartment 150 is first sensed in order to determine whether or not the sensed temperature is higher than a set temperature. The sensing for the temperature of the refrigerating compartment 150 is carried out by a plurality of refrigerating compartment temperature sensors 152. In this case, temperatures respectively sensed by the refrigerating compartment temperature sensors 152 may be individually compared with the set temperature. Alternatively, an average value of the temperatures respectively sensed by the refrigerating compartment temperature sensors 152 may be compared with the set temperature.

When it is determined that the temperature of the refrigerating compartment 150 is higher than the set temperature, it is determined whether or not a difference between a temperature deviation between portions of the refrigerating compartment 150 (namely, the middle and lower refrigerating compartment portions) is higher than an allowable temperature deviation. Where the measured temperature deviation is not higher than the allowable temperature deviation, even though the sensed temperature of the refrigerating compartment 150 is higher than the set temperature the cold air distribution assembly 220 rotates so that the baffle plate 222 is in the state of FIG. 10A. In this state, cold air introduced in the refrigerating compartment duct 200 is uniformly discharged into the refrigerating compartment 150 through both the refrigerating compartment cold air outlets 202 and 204.

When it is determined that the measured temperature deviation of the refrigerating compartment 150 is higher than the allowable temperature deviation, the cold air distribution assembly 220 rotates so that the baffle plate 222 is in the state of FIG. 10C or 10D. For instance, when it is determined that the temperature at the middle portion of the refrigerating compartment 150 is higher than the temperature at the lower portion of the refrigerating compartment 150 beyond the allowable temperature deviation, the baffle plate 222 is set to the state of FIG. 10C. In this state, cold air is concentratedly introduced into the middle guide duct 210 so that it is concentratedly discharged into the middle portion of the refrigerating compartment 150 through the middle cold air outlet 202. On the other hand, when it is determined that the temperature at the lower portion of the refrigerating compartment 150 is higher than the temperature at the middle portion of the refrigerating compartment 150 beyond the allowable temperature deviation, the baffle plate 222 is set to the state of FIG. 10D. In this state, cold air is concentratedly introduced into the lower guide duct 214 so that it is concentratedly discharged into the lower portion of the refrigerating compartment 150 through the lower cold air outlet 204. Such cases correspond to the case wherein the middle or lower portion of the refrigerating compartment 150 has increased in temperature due to a new load stored therein.

When it is determined that the temperature of the freezing compartment 160 is higher than the set temperature associated with the freezing compartment 160, even though the temperature of the refrigerating compartment 10 is satisfied, the baffle plate 222 is set to the state of FIG. 10B. In this state, the supply of cold air to the refrigerating compartment 150 is cut off. This state corresponds to a state in which cold air is supplied in a concentrated manner only to the freezing compartment 160.

As is apparent from the above description, the above-mentioned embodiment of the present invention is configured to concentratedly supply cold air to the freezing compartment 160 or refrigerating compartment 150 when that compartment increases in temperature over its set temperature. This embodiment is also configured to concentratedly supply cold air to a portion of the refrigerating compartment 150 which is increasing in temperature. The cold air supplying method according to the second embodiment of the present invention is substantially similar to the cold air supplying method according to the first embodiment. In the second embodiment, the temperature control for the refrigerator is achieved by preferentially performing the temperature control for the refrigerating compartment 150, as in the first embodiment. That is, the step of determining the temperature of the refrigerating compartment 150 is executed prior to the step of determining the temperature of the freezing compartment 160. However, it is possible to preferentially perform the temperature control for the freezing compartment 60 by executing the step of determining the temperature of the freezing compartment 160 prior to the step of determining the temperature of the refrigerating compartment 150.

In accordance with the second embodiment of the present invention, cold air may be introduced in a concentrated manner into the middle or lower guide duct 210 or 214 of the refrigerating compartment duct 200 and discharged in a concentrated manner into the middle or lower portion of the refrigerating compartment 150 through the middle or lower c6ld air outlet 202 or 204. In this embodiment, cold air may also be introduced into the common guide duct 212 and discharged in a common manner into the middle and lower portions of the refrigerating compartment 150 through the middle and lower cold air outlets 202 and 204.

Figure 11:
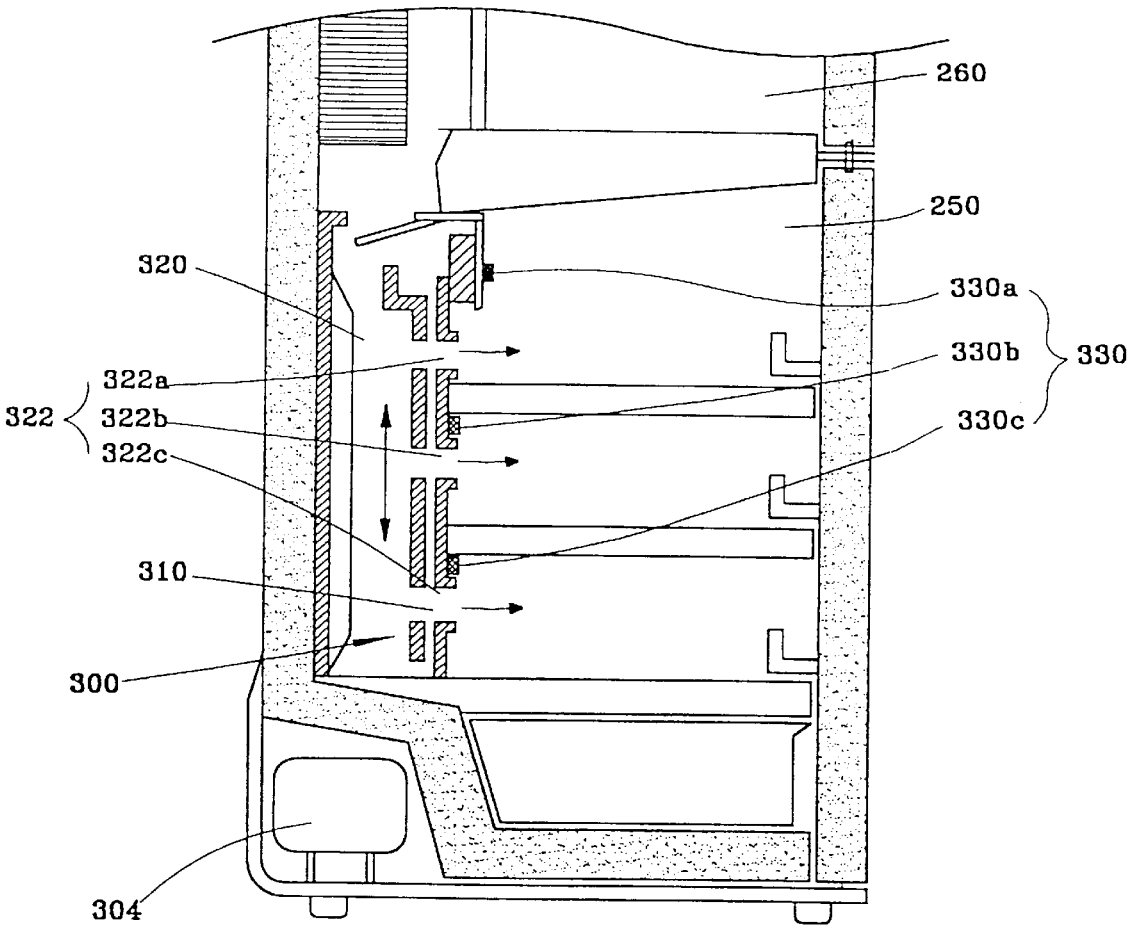
FIG. 11 is a sectional view illustrating the configuration of a cold air supplying apparatus according to a third embodiment of the present invention applied to a refrigerator.
Figure 12:
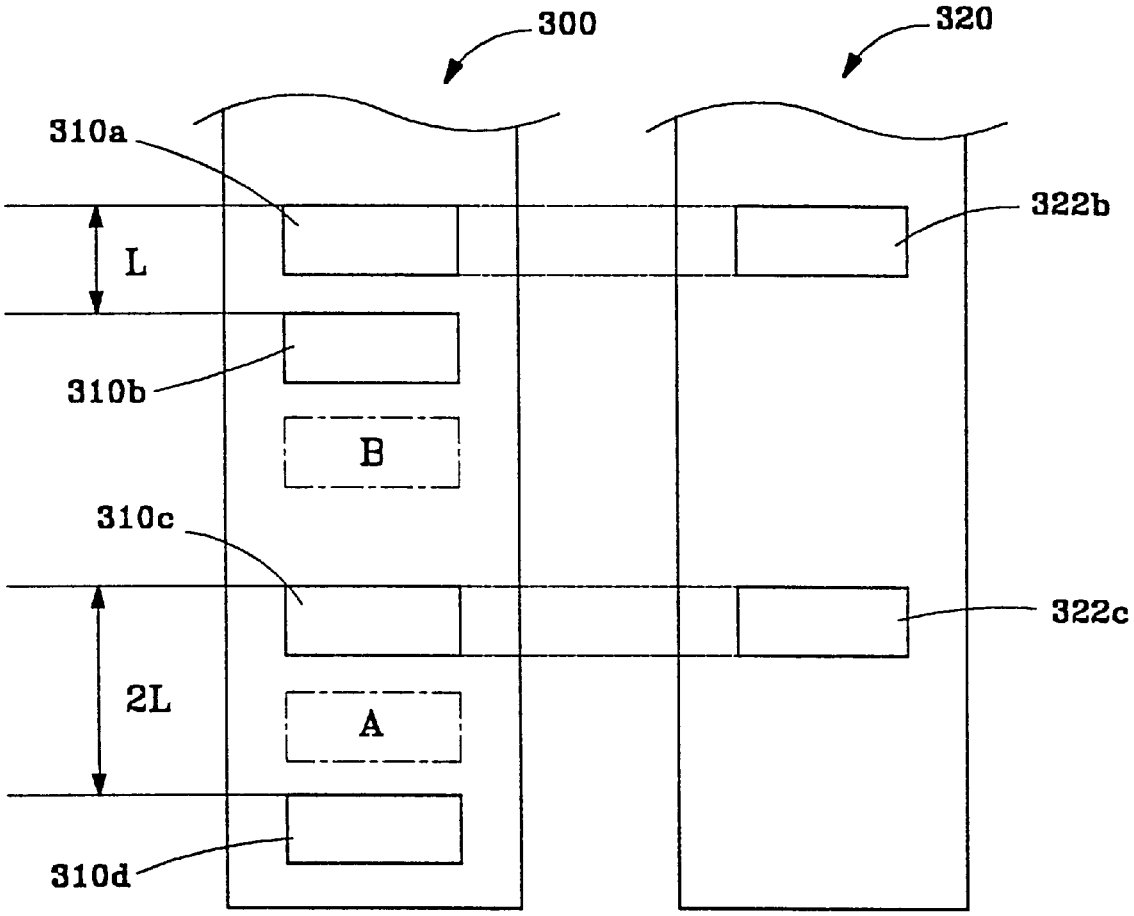
FIG. 12 is a schematic view illustrating a slider according to the third embodiment of the present invention.

Referring to FIGS. 11 and 12, a cold air supplying apparatus for a refrigerator configured in accordance with a third embodiment of the present invention is illustrated. The configuration of this embodiment is adapted to carry out a concentrated cooling for the refrigerating compartment of the refrigerator by concentratedly supplying cold air to the refrigerating compartment, based on temperatures at portions of the refrigerating compartment or an average temperature of the refrigerating compartment.

As shown in FIG. 11, a plurality of refrigerating compartment temperature sensors 330 are disposed at different portions of a refrigerating compartment 250 defined in the interior of the refrigerator in order to sense temperatures of the refrigerating compartment portions, respectively. In the illustrated case, the refrigerating temperature sensors 330 include an upper temperature sensor 330*a*, a middle temperature sensor 330*b*, and a lower temperature sensor 330*c*. The supply of cold air to the refrigerating compartment 250 is carried out via a refrigerating compartment duct 320. The refrigerating compartment duct 320 is provided with a plurality of cold air outlets 322. The cold air outlets 322 include an upper cold air outlet 322*a*, a middle cold air outlet 322*b*, and a lower cold air outlet 322*c*.

A slider 300 is slidably mounted on a portion of the refrigerating compartment duct 320 where the cold air outlets 322 are formed, in order to selectively open and close the cold air outlets 322. The slider 300 is provided with a plurality of selection holes 310 arranged at appropriate positions in such a manner that each selection hole 310 is aligned with an associated one of the cold air outlets 322 when the slider 300 moves vertically a desired distance, thereby opening the associated cold air outlet 322. In other words, one of the upper, middle and lower cold air outlets 322*a*, 322*b* and 322*c* or all of them are selected to be open by the selection holes 310 of the slider 300 in accordance with a moved position of the slider 300.

FIG. 12 illustrates the relation between the selection holes 310 of the slider 300 and the cold air outlets 322 of the refrigerating compartment duct 320. In this embodiment, the upper cold air outlet 322*a* of the refrigerating compartment duct 320 is configured to be always open. Accordingly, the upper cold air outlet 322*a* is not shown in FIG. 12. As shown in FIG. 12, the middle and lower cold air outlets 322*b* and 322*c* are selectively opened and closed by the selection holes 310 of the slider 300.

In the case of FIG. 12, the slider 300 has four selection holes 310*a*, 310*b*, 310*c* and 310*d* which serve to selectively open the middle or lower cold air outlet 322*b* or 322*c* of the refrigerating compartment duct 320 or to open both the middle and lower cold air outlets 322*b* and 322*c*.

The four selection holes 310*a*, 310*b*, 310*c* and 310*d* are vertically arranged while being spaced from one another by desired distances, respectively. The space between the selection holes 310*a* and 310*c* corresponds to the space between the middle and lower cold air outlets 322*b* and 322*c*. Accordingly, when the middle and lower cold air outlets 322*b* and 322*c* are aligned with the selection holes 310*a* and 310*c*, respectively, they are open. When the slider 300 moves downwardly a distance corresponding to the height of each cold air outlet 322 in this state, the middle and lower cold air outlets 322*b* and 322*c* are closed by the slider.

The space between the selection holes 310*c* and 310*d* is larger than the space between the selection holes 310*a* and 310*b* by a length corresponding to the height of each cold air outlet 322. Accordingly, when the slider 300 moves upwardly a distance L corresponding to the space between the selection holes 310*a* and 310*b* from the state of FIG. 12, the middle cold air outlet 322*b* is aligned with the selection hole 310*b*, so that it is open. In this state, the lower cold air outlet 322*c* is closed by a portion A of the slider 300, so that it is closed. Accordingly, there is no cold air discharged through the lower cold air outlet 322*c*. That is, the upward movement of the slider 300 by the distance L causes only the middle cold air outlet 322*b* to be open. When the slider 300 moves further the distance L from this state, the lower cold air outlet 322*c* is aligned with the selection hole 310*d*, so that it is open. In this state, the middle cold air outlet 322*b* is closed by a portion B of the slider 300, so that it is closed. That is, only the lower cold air outlet 322*c* is open. Thus, it is possible to selectively open the middle cold air outlet 322*b* or lower cold air outlet 322*c* or to open both the middle and lower cold air outlets 322*b* and 322*c* by upwardly or downwardly moving the slider 300 by a desired distance.

The upward and downward movements of the slider 300 are carried out by an actuating mechanism including a stepping motor. For example, it is possible to slide the slider 300 to a desired position, using a drive motor and a conventional mechanism configured to convert rotation of the drive motor into reciprocal linear movement.

As the slider 300 moves upwardly or downwardly, it may open all cold air outlets 322 of the refrigerating compartment duct 320, so that cold air is uniformly supplied to the entire portion of the refrigerating compartment 250. The slider 300 may also open a selected one of the cold air outlets 322, so that cold air is concentratedly supplied to a selected portion of the refrigerating compartment 250.

Now, a cold air supplying method carried out using the cold air supplying apparatus according to the above-mentioned embodiment of the present invention will be described in conjunction with FIG. 13.

Figure 13:
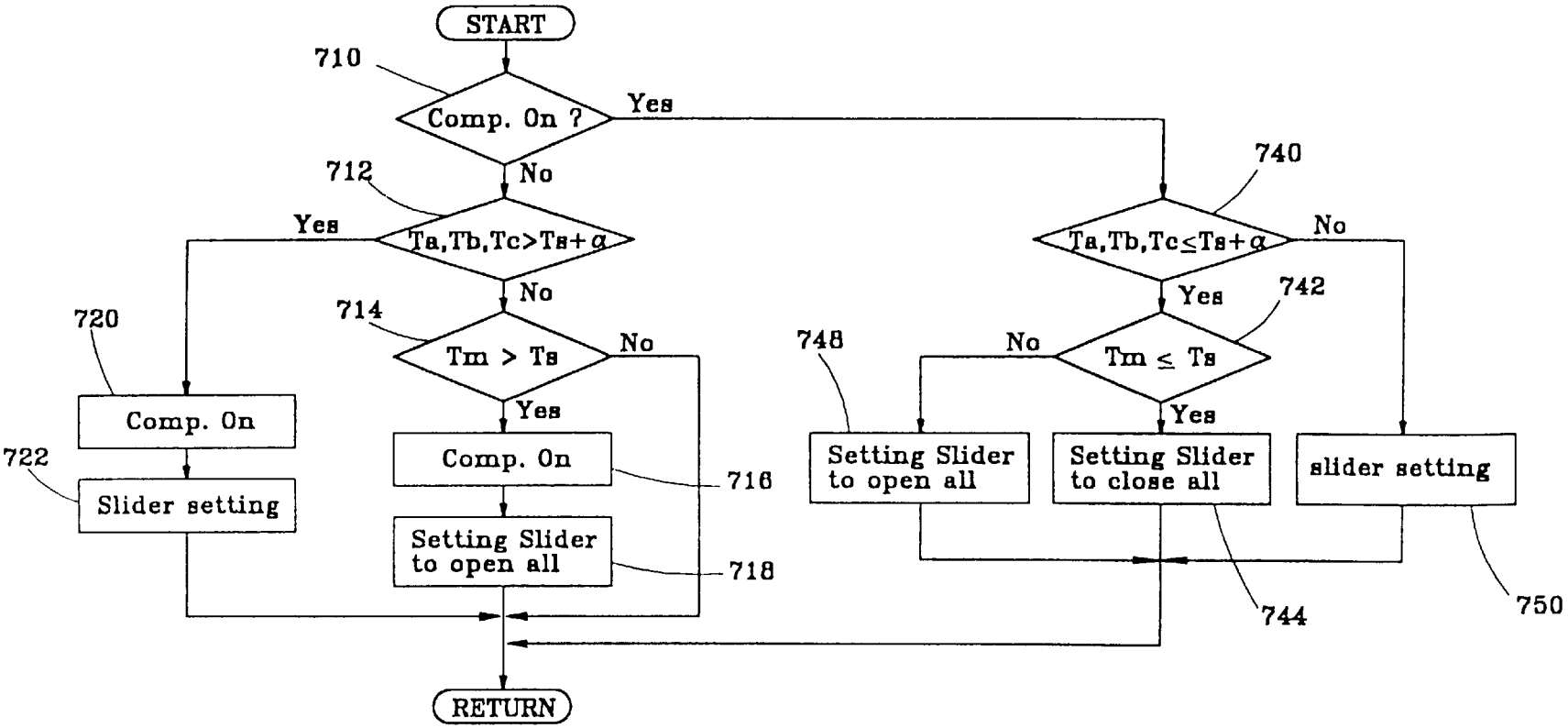
FIG. 13 is a flow chart illustrating a cold air supplying method carried out using the cold air supplying apparatus according to the third embodiment of the present invention.

FIG. 13 is a flow chart illustrating a cold air supplying procedure carried out in accordance with the cold air supplying method in the case wherein a refrigerating cycle is driven under the condition in which the temperature of the freezing compartment 260 is preferentially taken into consideration, in order to supply cold air to the refrigerating compartment in accordance with the state of the refrigerating compartment.

It is first determined whether or not a compressor 304 turns on by determining the temperature condition of the freezing compartment 260 (Step 710). When it is determined that the compressor 304 is in its OFF state, the temperature of the refrigerating compartment 250 is determined at step 712. That is, it is determined whether or not at least one of the temperatures Ta, Tb and Tc of the upper, middle and lower portions of the refrigerating compartment 250 respectively sensed by the upper, middle and lower temperature sensors 330*a*, 330*b* and 330*c* is higher than a set temperature Ts beyond an allowable temperature deviation $\alpha$. The refrigerating compartment 250 may have a portion exhibiting a temperature higher than the set temperature beyond the allowable temperature deviation a. For this reason, it is determined whether or not there is a portion of the refrigerating compartment 250 exhibiting a temperature excessively higher than the set temperature. For instance, it is determined whether or not there is a portion of the refrigerating compartment 250 increasing in temperature due to a new load stored therein. When it is determined at step 712 that at least one of the sensed temperatures Ta, Tb and Tc is higher than a set temperature Ts beyond the allowable temperature deviation $\alpha$, the refrigerating cycle is driven at step 720. In this state, cold air is concentratedly supplied to the temperature-increasing portion of the refrigerating compartment 250 by appropriately moving the slider 300 in an upward or downward direction (Step 722).

On the other hand, where it is determined at step 712 that all the sensed temperatures Ta, Tb and Tc satisfy the set temperature condition for the refrigerating compartment 250, it is determined at step 714 whether or not an average temperature Tm of the refrigerating compartment 250 is higher than the set temperature Ts. When it is determined at step 714 that the average temperature Tm is lower than the set temperature Ts, the present routine is completed. The procedure then returns to the first step.

When it is determined at step 714 that the average temperature Tm does not satisfy the temperature condition for the refrigerating compartment 250, namely, it is higher than the set temperature Ts, the compressor 304 turns on (Step 716). In this state, the slider 300 moves to open all cold air outlets 322 (step 718*a*), so that cold air is uniformly supplied to all portions of the refrigerating compartment 250.

Thereafter, the procedure returns to step 710 at which it is determined whether or not the compressor 304 is in its ON state. The ON state of the compressor 304 means that the temperature of the freezing compartment 260 is higher than a set temperature associated with the freezing compartment 260. In this state, namely, the ON state of the compressor 304, it is determined at step 740 whether or not each of the temperatures Ta, Tb and Tc of the upper, middle and lower portions of the refrigerating compartment 250 satisfies the allowable temperature deviation condition for the refrigerating compartment 250. That is, it is determined whether or not there is a portion of the refrigerating compartment 250 excessively increasing in temperature due to a new load stored therein. When it is determined that there is a portion of the refrigerating compartment 250 excessively increasing in temperature, a movement of the slider 300 is carried out to open the cold air outlet 322 associated with the temperature-increasing portion of the refrigerating compartment 250 at step 750.

Where it is determined that all the temperatures Ta, Tb and Tc exhibit no excessive temperature increase, namely, all of them satisfy the allowable temperature deviation condition, it is determined at step 742 whether or not the average temperature Tm of the refrigerating compartment 250 is lower than the set temperature Ts to satisfy the set temperature condition for the refrigerating compartment 250. When it is determined that the average temperature Tm is lower than the set temperature Ts, namely, the temperature condition of the refrigerating compartment 250 is appropriate, a movement of the slider 300 is carried out to close all the cold air outlets 322 at step 744. Thereafter, the procedure returns to the first step. In this state, cold air produced by the driving of the refrigerating cycle is not supplied to the refrigerating compartment 250. That is, the cold air is supplied only to the freezing compartment 260. When the freezing compartment 260 is cooled below its set temperature, the driving of the freezing cycle is stopped.

Where it is determined at step 742 that the average temperature Tm of the refrigerating compartment 250 not lower than the set temperature Ts, a movement of the slider 300 is carried out at step 748 to open all cold air outlets 322, thereby uniformly supplying cold air to all portions of the refrigerating compartment 250, because the entire portion of the refrigerating compartment exhibits an increase in temperature.

In this embodiment, although the driving of the refrigerating cycle is determined on the basis of the temperature of the freezing compartment, the refrigerating cycle is also driven when the temperature of a portion of the refrigerating compartment or the average temperature of the refrigerating compartment increases, in order to supply cold air. In accordance with this embodiment, a local temperature variation occurring in the refrigerating compartment 250 is preferentially determined. Based on the result of the determination, a movement of the slider 300 is carried out to concentratedly supply cold air through the cold air outlet associated with the temperature-increasing portion of the refrigerating compartment 250.

As apparent from the above description, this embodiment is configured to control the supply of cold air to the refrigerating compartment, based on the temperature condition of the refrigerating compartment as well as the temperature of the freezing compartment.

Figure 14:
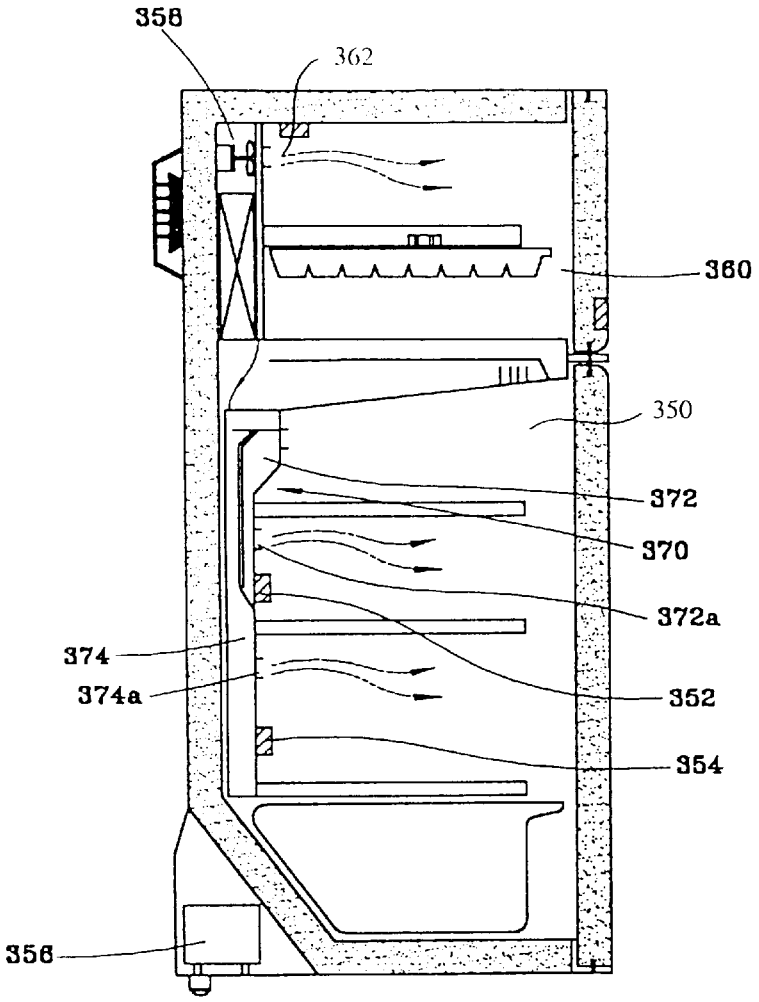
FIG. 14 is a sectional view illustrating the configuration of a cold air supplying apparatus according to a fourth embodiment of the present invention applied to a refrigerator.

Referring to FIG. 14, a cold air supplying apparatus for a refrigerator configured in accordance with a fourth embodiment of the present invention is illustrated.

As shown in FIG. 14, a plurality of refrigerating compartment temperature sensors (in the illustrated case, two temperature sensors 352 and 354) are disposed at the middle and lower portions of a refrigerating compartment 350 defined in the interior of the refrigerator in order to sense temperatures of the middle and lower refrigerating compartment portions, respectively. In order to supply cold air to the refrigerating compartment 350, a refrigerating compartment duct 370 is also provided which has middle and lower cold air outlets 372*a* and 374*a* respectively adapted to discharge cold air into the middle and lower portions of the refrigerating compartment 350. In accordance with this embodiment, it is also possible to provide an upper cold air outlet in addition to the middle and lower cold air outlets 372*a* and 374*a*. Since such an upper cold air outlet has the same basic configuration as those of the middle and lower cold air outlets for supplying cold air, its detailed description will be omitted.

The refrigerating compartment duct 370 is divided into a middle guide duct 372 for supplying cold air to the middle cold air outlet 372*a* and a lower guide duct 374 for supplying cold air to the lower cold air outlet 374*a*. By virtue of the middle and lower guide ducts 372 and 374 divided from the refrigerating compartment duct 370, it is possible to independently supply cold air to the middle and lower cold air outlets 372 and 374. In the illustrated case, although the middle and lower guide ducts 372 and 374 are divided from the interior of the refrigerating compartment duct 370, they may have the form of separate paths, respectively. In FIG. 14, reference numeral 358 is a fan and reference numeral 356 is a compressor.

The division of the refrigerating compartment duct 370 into the ducts 372 and 374 may be obtained using the vertical partition plate 106 as shown in FIG. 4. In accordance with this fourth embodiment, a twin damper 380 shown in FIG. 15 is used to independently supply cold air to the middle and lower guide ducts 372 and 374.

Figure 15:
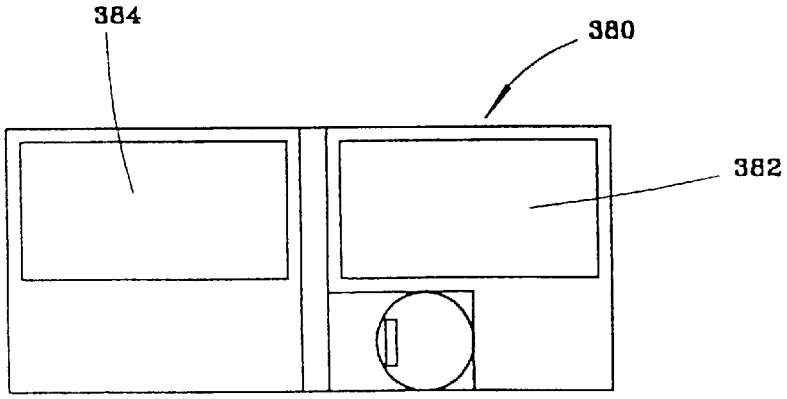
FIG. 15 is a schematic view illustrating a twin damper according to the fourth embodiment of the present invention.

As shown in FIG. 15, the twin damper 380 is configured to control the opening and closing of a pair of baffles 382 and 384 included therein, using a single drive motor, thereby selectively controlling the supply of cold air to the middle guide duct 372 or lower guide duct 374. Since the configuration of the twin damper 380 is well known, its detailed description will be omitted. The twin damper includes a drive motor, and a pair of gears engaging with each other. The gears are rotated by the drive motor. The gears are provided with cam portions, respectively. The baffles 382 and 384 are operatively connected to the cam portions of the gears, respectively. By this configuration, the cam portions of the gears operatively connected to the baffles 382 and 384 vary in height, thereby controlling the opening and closing of the baffles 382 and 384, respectively. That is, the baffles 382 and 384 repeat a state change among a fully open state, a fully closed state, and a state in which one baffle is open while the other baffle is closed. Accordingly, the baffles 382 and 384 of the twin damper 380 can be adjusted to selectively open and close, or to fully open and close the middle and lower guide ducts 372 and 374.

In the case of FIG. 15, the baffles 382 and 384 are arranged at the upper ends of paths along which cold air is supplied to the middle and lower guide ducts 372 and 374, respectively. Accordingly, the opened degrees of the baffles 382 and 384 determine the amounts of cold air supplied to the guide ducts 372 and 374, respectively.

A cold air supplying method carried out using the cold air supplying apparatus according to the above-mentioned embodiment of the present invention will now be described. This cold air supplying method is similar to that of the embodiment illustrated in FIGS. 3 to 6. That is, the supply of cold air to the freezing or refrigerating compartment is controlled on the basis of the temperature sensed by the freezing compartment temperature sensor 362 or refrigerating compartment temperature sensors 352 and 354. In particular, it is possible to achieve a concentrated supply of cold air to a temperature-increasing portion of the refrigerating compartment, based on the temperatures respectively sensed by the refrigerating compartment temperature sensors 352 and 354. For instance, where only the freezing compartment 360 exhibits a temperature higher than its set temperature, both the baffles 382 and 384 of the twin damper 380 are closed to cut off the supply of cold air to the refrigerating compartment 350, so that cold air is supplied in a concentrated manner only to the freezing compartment 360. Where both the refrigerating and freezing compartments 350 and 360 exhibit temperature higher than their set temperatures, respectively, both the baffles 382 and 384 of the twin damper 380 are open to supply cold air both the refrigerating and freezing compartments 350 and 360.

When the middle portion of the refrigerating compartment 350 exhibits a temperature higher than its set temperature beyond an allowable temperature deviation, only the middle guide duct 372 of the twin damper 380 is open so that cold air is supplied in a concentrated manner only to the middle portion of the refrigerating compartment 350 through the middle cold air outlet 372*a*. Of course, only the lower guide duct 374 of the twin damper 380 can be open by controlling the twin damper 380 so that cold air is supplied in a concentrated manner only to the lower portion of the refrigerating compartment 350 through the lower cold air outlet 374*a*.

As apparent from the above description, the present invention provides various effects.

That is, in accordance with the present invention, the refrigerating cycle is driven when at least one of the freezing and refrigerating compartments exhibits a temperature higher than its set temperature, so that the freezing and refrigerating compartments are maintained at their set temperatures, respectively. On the contrary, in accordance with the prior art, the refrigerating cycle is driven on the basis of the temperature of only one of the freezing and refrigerating compartments. In accordance with the present invention, therefore, it is possible to achieve an improvement in the reliability of the refrigerator, thereby achieving a maintenance of foods in a fresh state.

In accordance with the present invention, the refrigerating compartment duct for guiding cold air to the refrigerating compartment consists of ducts divided from the refrigerating compartment duct in association with cold air discharge positions. By virtue of such a configuration, cold air can be concentratedly supplied to a temperature-increasing portion of the refrigerating compartment. Accordingly, it is possible to rapidly cool the refrigerating compartment when a new load is stored in the refrigerating compartment.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for supplying cold air in a refrigerator including temperature sensing means adapted to sense respective temperatures of different portions of a refrigerating compartment defined in the refrigerator and a temperature of a freezing compartment defined in the refrigerator, and cold air supplying means adapted to supply cold air to the portions of the refrigerating compartment and the freezing compartment, comprising the steps of:

sensing respective temperatures of the portions of the refrigerating compartment and a temperature of the freezing compartment;

when all the sensed temperatures of refrigerating compartment portions are higher than an associated set temperature, uniformly supplying cold air to all the portions of the refrigerating compartment;

when at least one of the sensed temperatures of the refrigerating compartment portions is higher than the associated set temperature, concentratedly supplying cold air to the refrigerating compartment portion exhibiting the temperature higher than the set temperature; and when the sensed temperature of the freezing compartment is higher than an associated set temperature, cutting off the supply of cold air to the refrigerating compartment.

2. The method in accordance with claim 1, wherein the step of uniformly supplying cold air to all the portions of the refrigerating compartment is carried out when the sensed temperatures of all the refrigerating compartment portions are higher than the set temperature.

3. The method in accordance with claim 1, wherein the step of uniformly supplying cold air to all the portions of the refrigerating compartment is carried out when an average value of the sensed temperatures of all the refrigerating compartment portions is higher than the set temperature.

4. A method for supplying cold air in a refrigerator including a plurality of temperature sensing means adapted to sense respective temperatures of different portions of a refrigerating compartment defined in the refrigerator, and cold air supplying means adapted to supply cold air to the portions of the refrigerating compartment, comprising the steps of:

sensing respective temperatures of the portions of the refrigerating compartment;

when at least one of the sensed temperatures is higher than an associated set temperature, concentratedly supplying cold air to the compartment portion exhibiting the temperature higher than the set temperature; and when an average temperature of the sensed temperatures is higher than the associated set temperature, uniformly supplying cold air to all the portions of the refrigerating compartment.

* * * * *